US007681259B2

(12) United States Patent
Jin

(10) Patent No.: US 7,681,259 B2
(45) Date of Patent: Mar. 23, 2010

(54) KNOCK DOWN HEADBOARD

(75) Inventor: Edmund Jin, Fremont, CA (US)

(73) Assignee: E & E Co., Ltd, Fremont, CA (US)

( * ) Notice: Subject to any disclaimer, the term of this patent is extended or adjusted under 35 U.S.C. 154(b) by 0 days.

(21) Appl. No.: 12/125,771

(22) Filed: May 22, 2008

(65) Prior Publication Data

US 2009/0288253 A1 Nov. 26, 2009

(51) Int. Cl.
*A47C 17/00* (2006.01)
*A47C 19/04* (2006.01)
*A47C 19/00* (2006.01)

(52) U.S. Cl. ..... 5/53.1; 5/183; 5/285

(58) Field of Classification Search ..... 5/53.1, 5/201, 202, 183, 285, 249
See application file for complete search history.

(56) References Cited

U.S. PATENT DOCUMENTS 867,820 A * 10/1907 Hamilton ..... 5/183
4,821,349 A 4/1989 Cohen
4,856,127 A * 8/1989 Lenger ..... 5/53.1
5,269,032 A 12/1993 Flocks
5,790,994 A * 8/1998 Leonard ..... 5/53.1
6,910,234 B1 6/2005 Thulin
7,159,253 B2 1/2007 Yang
2003/0145377 A1* 8/2003 Paul ..... 5/53.1
2008/0313808 A1* 12/2008 Crue ..... 5/183

* cited by examiner

*Primary Examiner*—Robert G. Santos
*Assistant Examiner*—Brittany M Wilson
(74) *Attorney, Agent, or Firm*—Lott & Friedland, P.A.

(57) ABSTRACT

A ready to assemble, expandable headboard that is capable of fitting different size mattresses and is packaged compactly so that a store and the resulting customer can easily carry the packaged headboard. A ready to assemble headboard and kit where the headboard is expandable yet easily assembled to result in a cushioned, fabric slipcovered headboard with a custom look.

16 Claims, 4 Drawing Sheets

KNOCK DOWN HEADBOARD

FIELD OF INVENTION

The invention relates generally to the furniture industry, specifically, knock down headboards which include slipcovers.

BACKGROUND OF THE INVENTION

Ready to assemble ("RTA") or "knock down" furniture is furniture that is assembled by the end consumer. RTA furniture is typically more economical than pre-assembled furniture, because it is easier to ship and is less expensive for the manufacturer to create. RTA furniture can be sold in chain department stores, because the unassembled pieces can be shipped in more compact packaging. Some upscale, or "high end" furniture also comes to the store or customer in a ready to assemble form. In high end versions, store personnel assembles the furniture at the customer's home upon delivery.

Headboards are pieces of bedroom furniture that are usually not sold as knock down furniture. Headboards include a rigid frame that is not readily portable. Most headboards are sold with a bedroom set and are required to be delivered to the customer's home fully assembled. This is especially true of upholstered headboards. Some upholstered headboards are even customized to match a homeowner's bedroom décor.

Slipcovers for headboards are known. Most slipcovers are designed for one particular type of cushioned headboard and are not designed to be sold apart from the headboard. Slipcovers allow a user to create different looks by alternating between slipcovers with different designs or patterns while retaining the underlying headboard structure. This allows a user to easily and quickly change the look of a room with relative ease and low cost.

U.S. Pat. No. 5,269,032 describes a portable, readily assembled, easily upholstered headboard. The headboard has two posts, two inter-fitting rails which are readily assembled and locked to the posts without tools. The headboard includes a muslin covered cushioned panel having a backing rigid sheet with rail-engaging formations.

U.S. Pat. No. 4,821,349 describes a fabric covered knock-down headboard for beds. The headboard frame includes a pair of side members temporarily held together by separable center sections. The center sections are of varying lengths. A fabric cover is formed from front and rear panels slightly greater in length than the length of the headboard frame. The cover is seamed around the top and side edges. The bottom edges of the panels are initially separated to allow the cover to slide over the frame, but when in place, are secured by hook and loop fastening mechanisms.

U.S. Pat. No. 7,159,253 describes a modular headboard and method of assembly. The modular headboard includes an upper headboard section and a lower headboard section selectively coupled together for convenient storage and transportation. The upper headboard includes laterally spaced, vertically extending upper post sections and a headboard panel extending there between. The lower headboard section includes corresponding lower post sections, with cross rails extending between the sections. A laterally extending slat overlaps adjacent edges of the upper and lower headboard sections to facilitate alignment of the upper and lower headboard sections, and is secured to the headboard sections to form a stable headboard.

U.S. Pat. No. 6,910,234 describes a collapsible headboard, ideally for use with an inflatable mattress. The collapsible headboard is intended to prevent pillows from falling off of the mattress. The collapsible headboard includes a frame assembly being selectively actuated between a collapsed position and a deployed position. The frame assembly is actuated to the collapsed position for facilitating storage for the frame assembly when the frame assembly is removed from the mattress. A panel member is designed for being positioned against the mattress whereby the panel member is for inhibiting pillows from sliding off of the mattress when the frame assembly is in the deployed position.

None of the apparatus mentioned above describe a knock down headboard to be constructed by an end user comprising a left side headboard section, a right side headboard section, at least one middle headboard section and support posts attachable to a bed frame wherein the middle headboard section includes an aperture for receiving attachment means to secure the middle headboard section to the left and right side headboard sections.

The apparatuses discussed above also do not describe a ready to assemble headboard kit for an expandable headboard comprising a left side headboard section, a right side headboard section, at least one middle headboard section and support posts attachable to a bed frame wherein the middle headboard section includes an aperture for receiving attachment means to secure the middle headboard section to the left and right side headboard sections. Moreover, none of the known prior art references disclose an expandable headboard that is padded and covered with fabric and also includes a decorative slipcover for a resulting headboard that appears to be tailored or custom made.

None of the prior art methods solve the problem of making a ready to assemble headboard that is capable of fitting different size mattresses, yet being packaged so that a store, and the resulting customer, can easily transport the packaged headboard. The references also do not disclose a ready to assemble headboard and kit where the headboard is expandable yet easily assembled to result in a cushioned, fabric slipcovered headboard with a custom look.

SUMMARY OF THE INVENTION

The current invention satisfies the above needs by providing a knock-down headboard to be assembeld by an end user comprising a left side headboard section, a right side headboard section, and at least one middle headboard section. The middle headboard section includes an aperture for receiving attachment means to secure one or more middle headboard sections to the left side headboard section and the right side headboard section. Support posts are attachable to the left side headboard and the right side headboard, wherein the support posts include slots for receiving a bed frame and an aperture for receiving attachment means to secure the support posts to the left side headboard and the right side headboard.

The current invention also provides a ready to assemble headboard kit for an expandable headboard comprising a left side headboard section, a right side headboard section, and at least one middle headboard section. The middle headboard section includes an aperture for receiving attachment means to secure the middle headboard section to the left side headboard section and the right side headboard section. Support posts are attachable to the left side headboard and the right side headboard. The support posts include slots for receiving a bed frame and an aperture for receiving attachment means to secure the support posts to the left side headboard and the right side headboard. Additional middle headboard sections may be added by attaching the additional middle headboards to increase the length of the headboard.

The invention further includes a ready to assemble headboard kit for an expandable headboard comprising a left side headboard section, a right side headboard section, and at least one middle headboard section. The middle headboard section includes an aperture for receiving attachment means to secure the middle headboard section to the left side headboard section and the right side headboard section. Support posts are attachable to the left side headboard and the right side headboard. The support posts include slots for receiving a bed frame and an aperture for receiving attachment means to secure the support posts to the left side headboard and the right side headboard. Additional middle headboard sections may be added by attaching the additional middle headboard sections to increase the length of the headboard. The left side headboard section, the right side headboard section, and the middle headboard section are composed of plywood with foam padding. The headboard kit consists of the headboard packaged in an unassembled state for ease of shipment in a compact package, the kit including discrete parts for the left side headboard section, the right side headboard section, the middle headboard section and the support posts.

These and other objects, features, and advantages of the present invention may be better understood and appreciated from the following detailed description of the embodiments thereof, selected for purposes of illustration and shown in the accompanying drawings.

DETAILED DESCRIPTION

Figure 1:
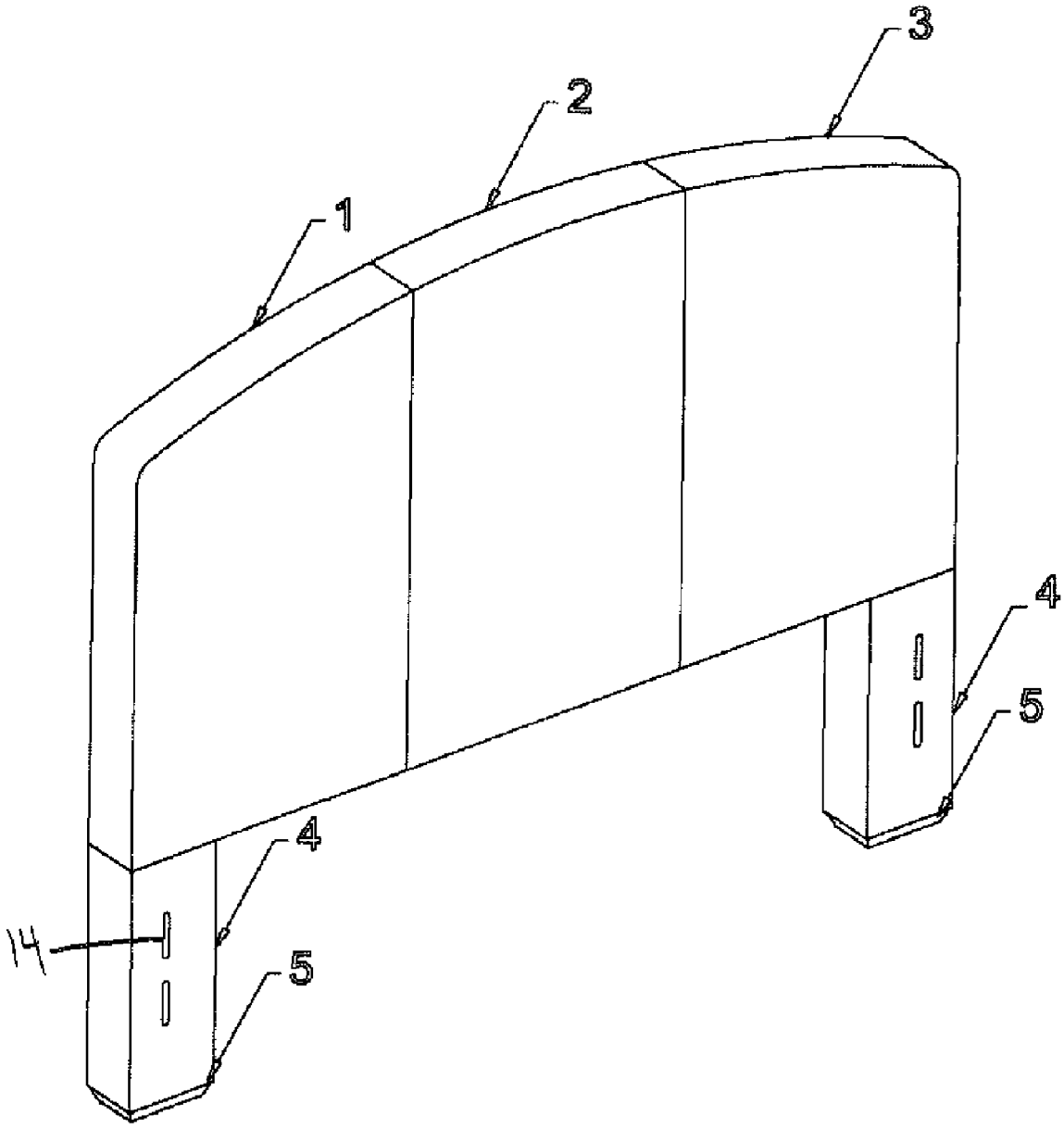
FIG. 1 is a perspective view of the front side of the knock down headboard.

FIG. 1 is a perspective view of the front side of the knock down headboard 15. The terms "knock down" and "ready to assemble" are used interchangeably herein to describe furniture that is packaged in pieces and is assembled by the end consumer. Shown are the left side headboard section 1, the middle headboard section 2 and the right side headboard section 3. Support posts 4 are located under the left side headboard section 1 and the right side headboard section 3. A wood base 5 is located directly under the support posts 4. When assembled, the front of the left side headboard section 1, the middle headboard section 2, and the right side headboard section 3 form a continuous, unitary headboard 15. When shipped to the store or consumer, the left side headboard section 1, the middle headboard section 2, the right side headboard section 3, and the support posts 4 are unassembled and placed in a compact package for ease of shipping and handling.

Figure 2:
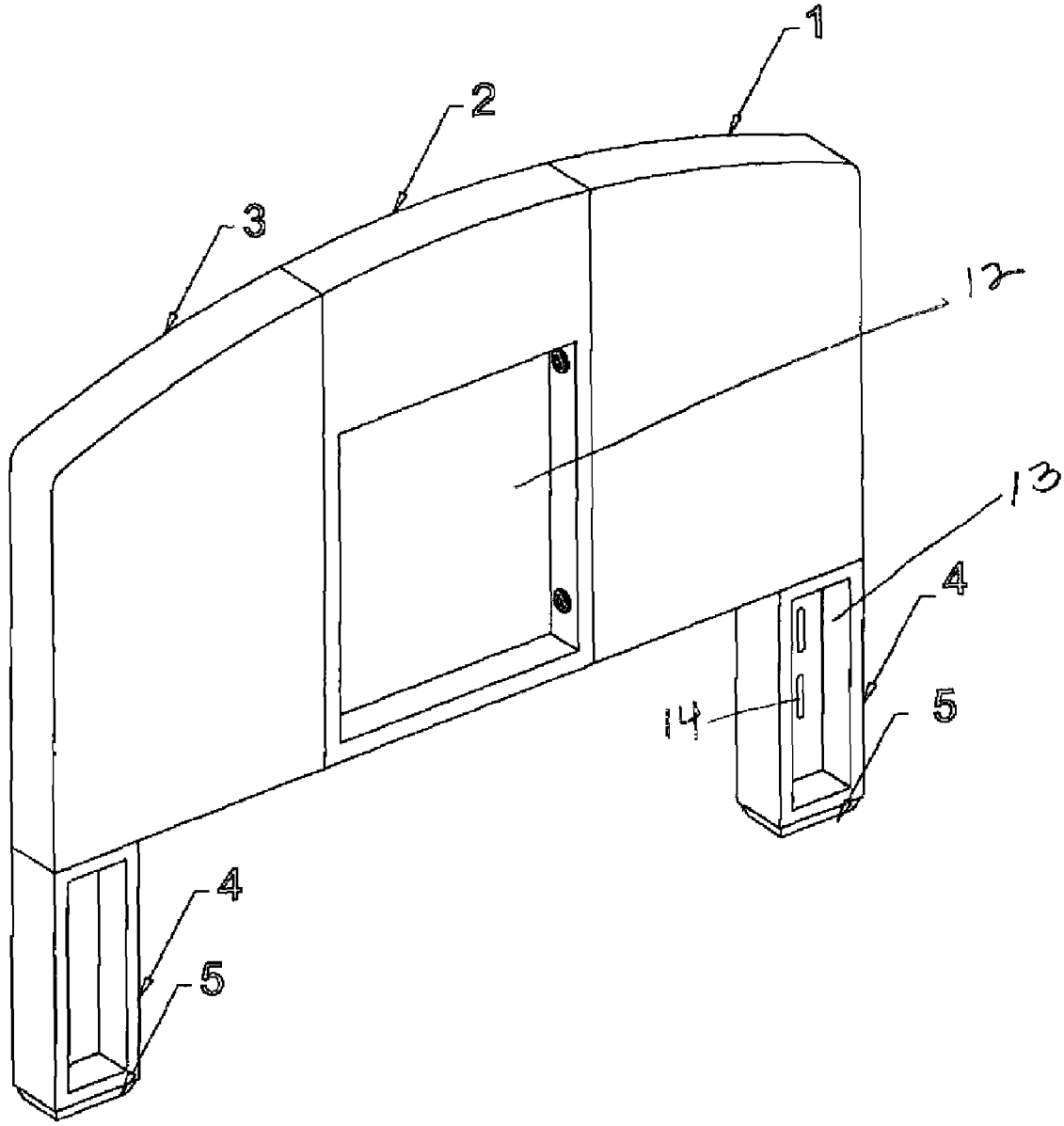
FIG. 2 is a perspective view of the back side of the knock down headboard.

FIG. 2 is a perspective view of the back side of the knock down headboard 15. Shown are the left side headboard section 1, the middle headboard section 2 and the right side headboard section 3. Support posts 4 are located under the left side headboard section 1 and the right side headboard section 3. A wood base 5 is located directly under the support posts 4. The middle headboard section 2 includes a hollowed aperture 12. The support posts 4 each also include a hollowed aperture 13. The hollowed apertures 12 and 13 allow a user to access portions of the frame for which assembly is required. The hollowed apertures 13 in the support posts 4 contain two slots 14 for receiving the bed frame. This secures the headboard 15 to the frame of the bed.

Figure 3:
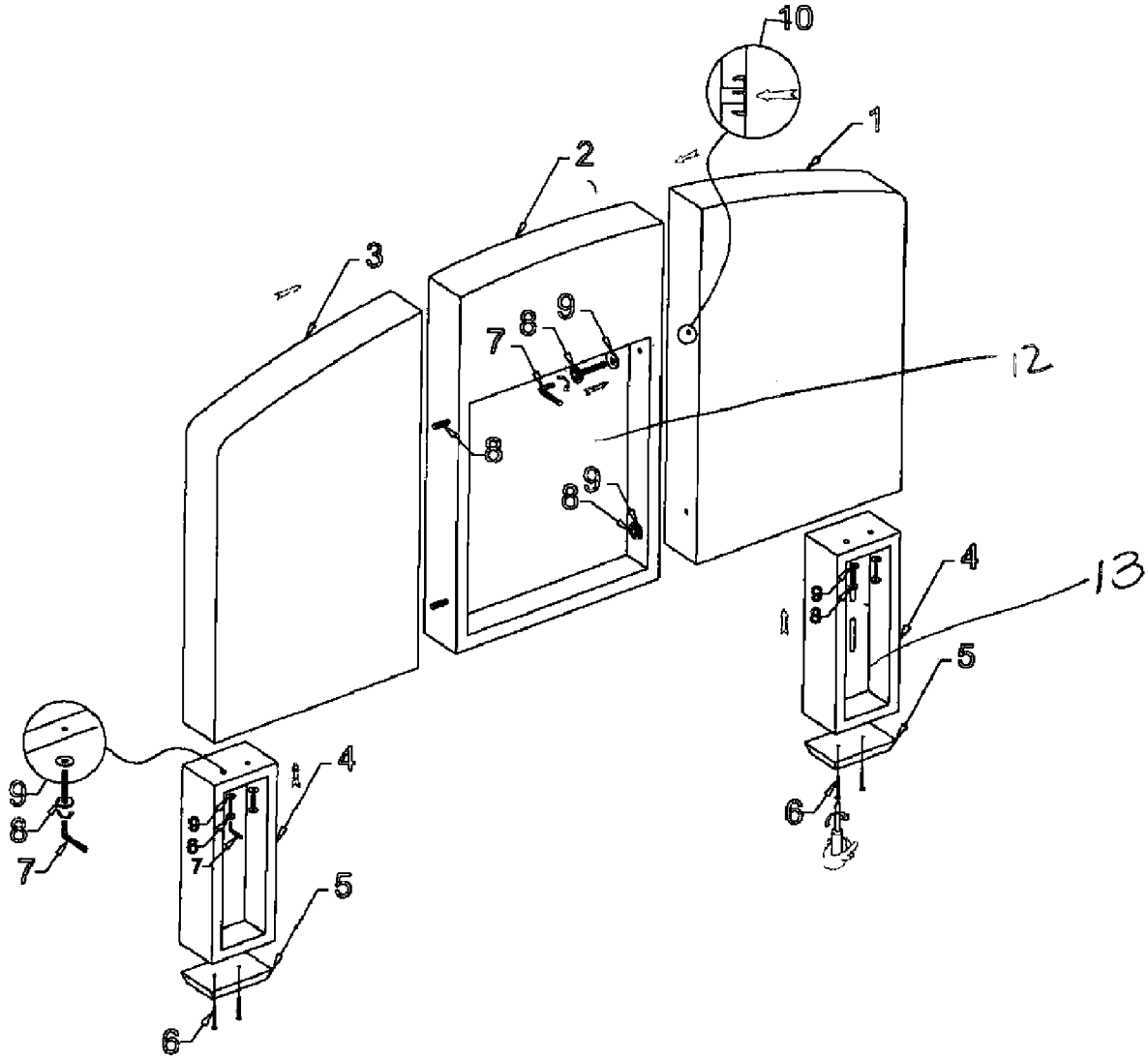
FIG. 3 is a perspective view of the back side of the knock down headboard.

FIG. 3 is a perspective view of the back side of the knock down headboard. Shown are the left side headboard section 1, the middle headboard section 2 and the right side headboard section 3. Support posts 4 are located under the left side headboard section 1 and the right side headboard section 3. A wood base 5 is located directly under the support posts 4. The middle headboard section 2 includes a hollowed aperture 12. The support posts 4 each also include a hollowed aperture 13.

Also shown in FIG. 3 are the attachment means. The wood base 5 is attached to the support posts 4 by base installation screws 6. The support posts 4 are attached to the respective left side headboard section 1 and right side headboard section 3 by bolts 8. Both of these attachment means are found in hollowed aperture 13. The bolts 8 may be screwed into position by an installation wrench 7 that comes in the headboard kit. A washer 9 is placed between the bolts 8 and the interior wall of the support posts 4 to prevent the bolts 8 from being screwed too far into the support posts 4 and damaging or cracking the wood.

The attachment means for the sections of the headboard 1, 2, and 3 are located in hollowed aperture 12 of the middle headboard section 2. A t-nut 10 is placed in the interior sides of the left side headboard section 1 and right side headboard section 3 for receiving bolts 8. The t-nut 10 is a threaded insert that puts steel threads into wood and has the greatest amount of pull-out resistance of all the threaded insert types. The bolts 8 used as the headboard attachment means also utilize washers 9 to prevent damage to the wood and secure the bolts 8. As shown in FIG. 3, four bolts may be used to secure the headboard. The number of bolts 8 used may be increased depending upon the type of material used to construct the headboard and the size of the headboard. Apertures 12 and 13 may be filled in or covered with a provided piece of wood, felt or cloth. Optionally, apertures 12 and 13 may be left open since they are located on the back side of the headboard 15.

Figure 4:
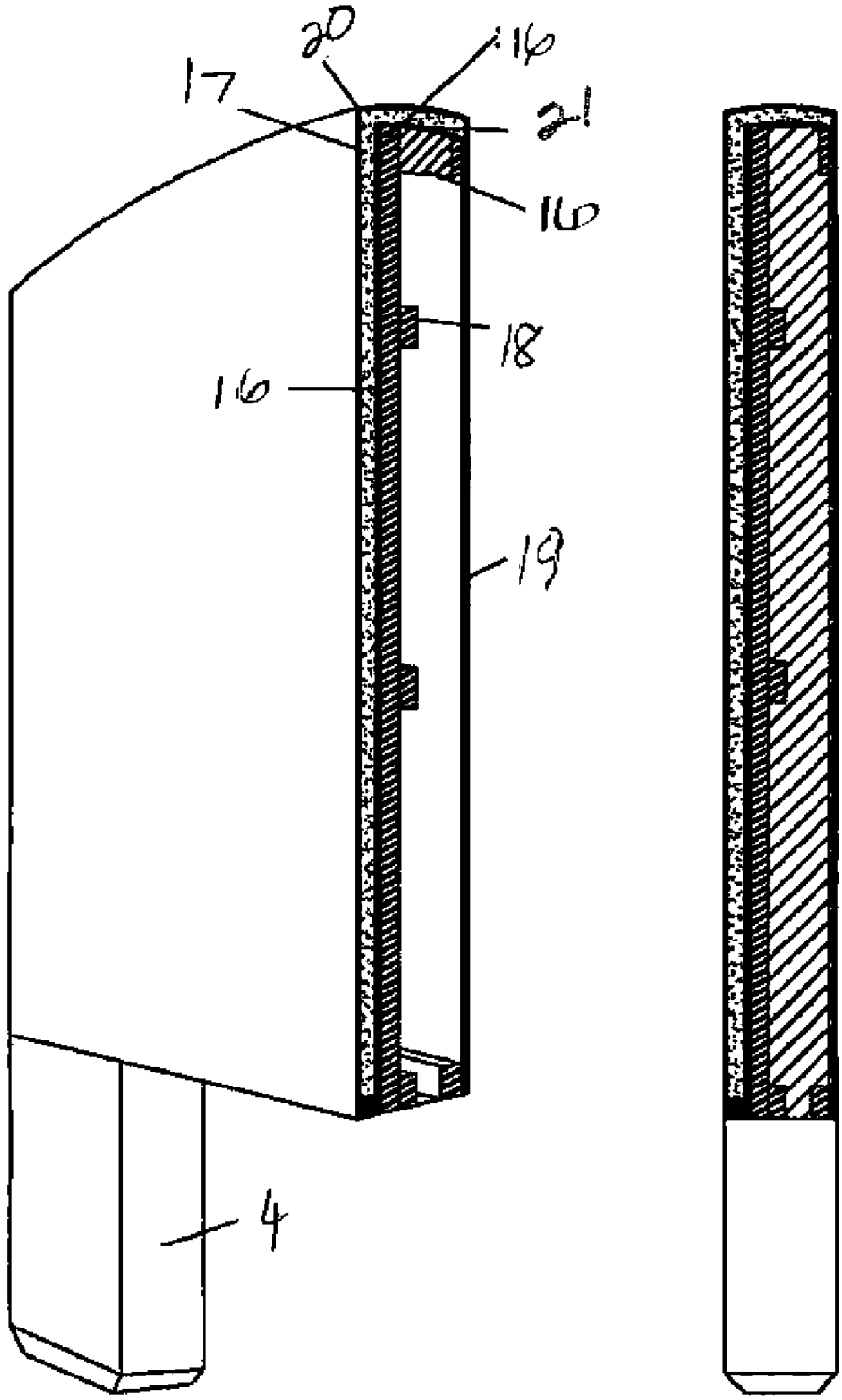
FIG. 4 is a cross section view of the headboard.

FIG. 4 is a cross section view of the headboard 15. Shown is the construction of the headboard frame which includes an inner plywood sheet 16, a solid wood frame support 18, a cardboard layer 21 for additional support, foam padding 17, a felt layer 19 for covering the apertures 12 and 13, and a composite cloth 20 creating an outside layer. The support posts 4 will be composed of hardwood to support the weight of the headboard 15. The headboard 15 can optionally include a slipcover that slips over the headboard 15. The slipcover can be coordinated to match the bedding or room.

The headboard 15 as shown in FIGS. 1, 2, and 3 is expandable by adding additional middle headboard sections 3. The headboard 15 as shown in FIGS. 1, 2 and 3 is slightly curved; however, the headboard 15 may be square. For example, the standard headboard 15 may be sized for a queen mattress. To expand the headboard 15 to fit a king mattress, a user would need to obtain extensions or additional middle headboard sections 3. These could come in a kit or be sold separately. Optionally, the kit could be sold to fit a twin size mattress with extensions available to make it fit a queen or king size mattress.

Accordingly, it will be understood that the preferred embodiments of the present invention have been disclosed by way of example and that other modifications and alterations may occur to those skilled in the art.

What is claimed is:

1. A knock-down headboard comprising:

a left side headboard panel;

a right side headboard panel;

at least one middle headboard panel, wherein a middle headboard panel includes in a back surface thereof a hollowed aperture for receiving attachment means to secure said at least one middle headboard panel to said left side headboard panel and said right side headboard panel; and support posts attachable to the underside said left side headboard panel and said right side headboard panel, wherein said support posts include slots for receiving a bed frame and an aperture for receiving attachment means to secure said support posts to said left side headboard panel and said right side headboard panel.

2. The knock-down headboard of claim 1, wherein the length of said headboard is expandable by increasing the number of middle headboard panels.

3. The knock-down headboard of claim 1, wherein said headboard includes a slipcover.

4. The knock-down headboard of claim 1, wherein said left side headboard panel, said right side headboard panel, and said at least one middle headboard panel are composed of plywood with a foam padding.

5. The knock-down headboard of claim 1, wherein said headboard is packaged in an unassembled state for ease of shipment in a compact package, including discrete parts for said left side headboard panel, said right side headboard panel, said at least one middle headboard panel and said support posts.

6. The knock-down headboard of claim 1, wherein said attachment means consists of bolts and t-nuts.

7. A ready to assemble headboard kit for an expandable headboard comprising:

a left side headboard panel;

a right side headboard panel;

at least one middle headboard panel, wherein a middle headboard panel includes in a back surface thereof a hollowed aperture for receiving attachment means to secure said at least one middle headboard panel to said left side headboard panel and said right side headboard panel;

support posts attachable to the underside said left side headboard panel and said right side headboard panel, wherein said support posts include slots for receiving a bed frame and an aperture for receiving attachment means to secure said support posts to said left side headboard panel and said right side headboard panel; and wherein additional said middle headboard panels may be added to increase the length of said headboard.

8. The ready to assemble headboard kit of claim 7, wherein said headboard kit includes a slipcover.

9. The ready to assemble headboard kit of claim 7, wherein said left side headboard panel, said right side headboard panel, and said at least one middle headboard panel are composed of plywood with a foam padding.

10. The ready to assemble headboard kit of claim 7, wherein said kit consists of said headboard packaged in an unassembled state for ease of shipment in a compact package, said kit including discrete parts for said left side headboard panel said right side headboard panel, said at least one middle headboard panel and said support posts.

11. The ready to assemble headboard kit of claim 7, wherein said attachment means consists of bolts and t-nuts.

12. The ready to assemble headboard kit of claim 7, wherein said headboard is expandable for use with a twin size mattress, a queen size mattress and a king size mattress.

13. A ready to assemble headboard kit for an expandable headboard comprising:

a left side headboard panel;

a right side headboard panel;

at least one middle headboard panel, wherein a middle headboard panel includes in a back surface thereof a hollowed aperture for receiving attachment means to secure said at least one middle headboard panel to said left side headboard panel and said right side headboard panel;

support posts attachable to the underside said left side headboard panel and said right side headboard panel, wherein said support posts include slots for receiving a bed frame and an aperture for receiving attachment means to secure said support posts to said left side headboard panel and said right side headboard panel;

wherein additional said middle headboard panels may be added to increase the length of said headboard;

wherein said left side headboard panel, said right side headboard panel, and said at least one middle headboard panel are composed of plywood with a foam padding; and wherein said kit consists of said headboard packaged in an unassembled state for ease of shipment of a compact package, said kit including discrete parts for said left side headboard panel, said right side headboard panel said at least one middle headboard panel and said support posts.

14. The ready to assemble headboard kit of claim 13, wherein said attachment means consists of bolts and t-nuts.

15. The ready to assemble headboard kit of claim 13, wherein said headboard is expandable allowing it to be used with a twin size mattress, a queen size mattress and a king size mattress.

16. The ready to assemble headboard kit of claim 13, wherein said headboard kit includes a slipcover to be placed over said headboard.

* * * * *